United States Patent [19]

Dumazeau et al.

[11] Patent Number: 5,071,043

[45] Date of Patent: Dec. 10, 1991

[54] STOPPER ROD WITH AN IMPROVED GAS DISTRIBUTION

[75] Inventors: Claude Dumazeau, Maubeuge; Pascal Dubois, Feignies, both of France

[73] Assignee: Vesuvius Crucible Company, Pittsburgh, Pa.

[21] Appl. No.: 555,570

[22] Filed: Jul. 19, 1990

[51] Int. Cl.[5] ..... B22D 37/00

[52] U.S. Cl. ..... 222/602; 222/603; 266/272; 266/225; 164/259; 164/415; 164/437; 164/337

[58] Field of Search ..... 164/337, 259, 437, 415; 222/597, 602, 603; 266/220, 272, 225

[56] References Cited

U.S. PATENT DOCUMENTS

| | | | |
|---|---|---|---|
| 3,083,422 | 4/1963 | Finkl | 222/602 |
| 3,214,804 | 11/1965 | Saccomano | 22/85 |
| 4,492,365 | 1/1985 | Desaar | 266/225 |
| 4,520,861 | 6/1985 | Sobolewski | 222/602 |
| 4,779,775 | 10/1988 | Kimura et al. | 164/415 |
| 4,791,978 | 12/1988 | Fishler | 164/437 |

FOREIGN PATENT DOCUMENTS

| | | | |
|---|---|---|---|
| 3246937 | 12/1981 | Fed. Rep. of Germany . | |
| 26206 | 8/1978 | Japan | 164/415 |
| 82256 | 5/1985 | Japan | 222/597 |
| 29610 | 6/1949 | Luxembourg . | |
| 952972 | 8/1982 | U.S.S.R. | 266/225 |
| 1062276 | 12/1983 | U.S.S.R. | 266/225 |

OTHER PUBLICATIONS

World Intellectual Property Organization Publication No., 85/05056 (21-11-85) by Lee.

Japanese Patent Abstract, vol. 10, No. 273, dated Sep. 17, 1986.

*Primary Examiner*—Richard K. Seidel

*Assistant Examiner*—Edward A. Brown

*Attorney, Agent, or Firm*—Webb Burden Ziesenheim & Webb

[57] ABSTRACT

The stopper rod for regulating the flow of a liquid has a body traversed by an axial channel and having at one end a porous nose fed with gas from the channel. The nose has a free space in the form of a hemisphere-shaped slot or lattice network communicating with the channel for delivery of gas thereto. Preferably, a plurality of spaced-apart bridges of solid material connect the two faces of the free space in order to increase the strength of the porous nose.

12 Claims, 2 Drawing Sheets

FIG. 2
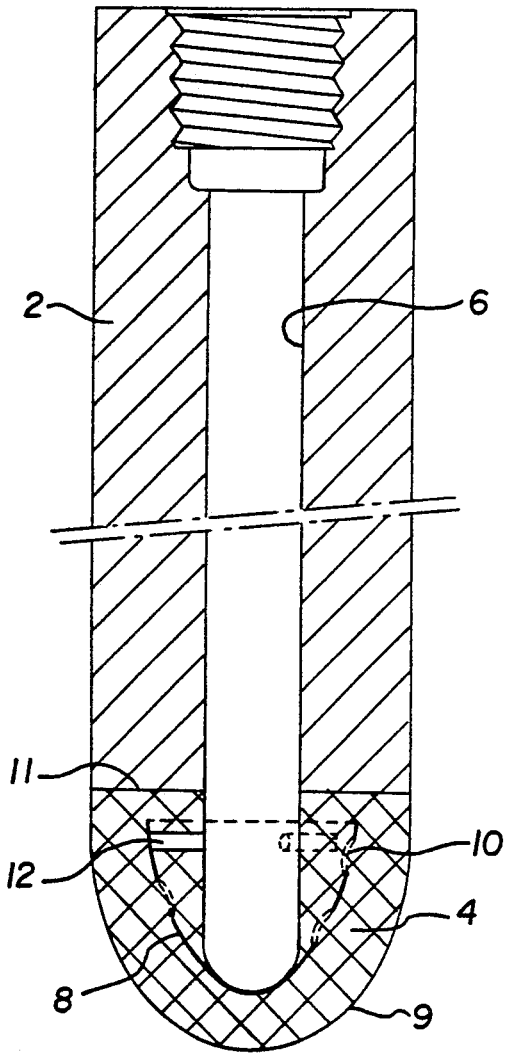
FIG. 5
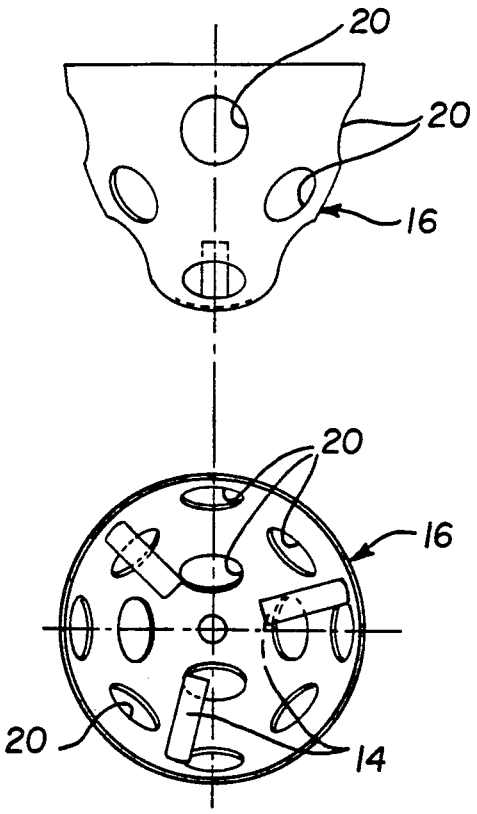
FIG. 6

STOPPER ROD WITH AN IMPROVED GAS DISTRIBUTION

BACKGROUND OF THE INVENTION

The invention concerns a stopper rod for regulating the flow of a liquid, having a porous part fed with gas.

Stopper rods are frequently used in industry for opening and closing an orifice of a receptacle containing a liquid such as molten steel in a metallurgical vessel. By movement of the stopper rod from the orifice of the receptacle, the flow rate of the liquid is regulated. In some cases, these flow regulating stopper rods have appropriate internal channels and /or porous portions which make it possible to blow a treating gas into the liquid contained in the receptacle. Thus, the use of a stopper rod for controlling the flow of a molten steel emerging from a tundish into a water-cooled, continuous-casting mold is well known. In addition, it is conventional practice to introduce an inert gas, generally argon, into the molten metal through the stopper rod. The purpose of the argon is to eliminate unwanted inclusions contained in the molten steel. Another purpose is to reduce the deposits of alumina that occur in the casting elements, particularly when casting aluminum killed steel. Finally, the injection of argon makes it possible to avoid the development of a vacuum inside of the casting elements. Such a vacuum is capable of causing an aspiration of air through the porous refractory casting elements which, in turn, causes harmful oxidation of the molten metal.

According to one known technique, the inert gas is injected by means of an axial channel that passes through the stopper rod and exits at the end thereof. A further known stopper rod has a separate, porous stopper or plug sealed in the refractory material at the end of the axial channel of the stopper rod for emitting the inert gas to the molten metal. In the case of the first-mentioned technique, the hole at the end of the stopper rod has a substantial diameter, on the order of 2–3 mm. Consequently, a back flow of molten metal can occur through this orifice in the case where the pressure of the inert gas is interrupted for any reason. Furthermore, the gas injection is localized at one point and induces large bubbles that are less effective for eliminating the impurities contained in the metal. The second solution mentioned above makes it possible to produce small bubbles distributed on the surface of the porous stopper, however, there is the risk of unsealing of this stopper which leads to a back flow of molten metal within the axial channel of the stopper rod.

U.S. Pat. No. 4,791,978 to Mark K. Fishler, and owned by assignee of the present invention, discloses a stopper rod having a porous nose isostatically copressed at the same time as the body. The porous nose has a composition similar to that of the body, but its permeability is much higher. The copressing makes it possible to avoid the risk of losing the porous nose.

Nevertheless, in the stopper rod according to U.S. Pat. No. 4,791,978, the internal surface of the end of the axial channel of the stopper rod is relatively small. In addition, the thickness of the porous material which must be traversed by the inert gas is substantial, e.g., on the order of 40 mm, for a stopper rod of current dimensions. These characteristics lead to a limitation of the inert gas flow rate obtained at elevated temperatures. Thus, the maximum flow rate of argon obtained at 1500° C. is about 6–8 Nl/min. for a molten metal counterpressure of 2.8 bar. This flow rate is insufficient in some cases and also the relatively substantial counterpressure that is necessary is dangerous for the axial channel, the connection of the stopper rod and the gas feed piping. The principal risk is the bursting of the nose during the casting, the catastrophic consequence of which would be loss of control of the molten metal flow. The second problem is a high risk of leakage in the gas connections, leading to the inefficacy of gas flow through the porous nose.

Given that a high resistance to erosion by steel is necessary, all the attempts made to increase the permeability of the porous material constituting the nose failed because an increase in the number of pores and/or an increase in their size result in an inacceptable reduction in the erosion resistance of the porous material.

The present invention provides a remedy to these shortcomings of the prior art.

An object of the invention is to create a stopper rod for regulating the flow of a liquid that preserves the advantages of stopper rods of the prior art, while permitting an increase in the flow rate of gas. The improved flow rate is obtained at a lower inert gas pressure than heretofore possible.

SUMMARY OF THE INVENTION

This result is obtained in accordance with the invention due to the fact that the porous nose has a free space into which the inert gas in introduced.

This free space has the effect of bringing the gas close to the outside surface of the stopper rod. Consequently, the flow rate of gas is increased for a same gas counterpressure value because the thickness of material to be traversed is decreased. The free space is preferably a slit that can be continuous or discontinuous. Preferably, bridges of material connect the two faces of the slits. These bridges avoid the loss of the outer part of the porous nose in the case where erosion due to the steel would reach the slit. According to the invention, the free space has a surface greater than the inside surface of the porous nose. Due to this characteristic, the contact surface between the inert gas and the porous material is increased. The passage cross section offered this gas is thus increased. Consequently, the flow rate of the gas is increased for the same value of the counterpressure.

According to one further embodiment, the space left free in the porous stopper is comprised of a network of channels or a mesh network provided in the porous material. It is obvious that the configuration of the free space is not limited to these examples, but can be chosen freely as a function of the needs of the user and the application.

Finally, in some applications, the thickness of the porous material separating the outer surface of the stopper of the free space is chosen so as to define at least a preferential zone of blowing. In other words, the distance that separates the free space, e.g., the slit, from the outer surface of the porous nose is not constant. It can be less in a given zone in order to obtain a greater flow rate of gas in this zone, the passage of the gas being facilitated by the decrease in the thickness of the wall to be traversed. Preferably, the free space is contained entirely in the porous stopper in order to avoid the development of fragile zones at the level of the interface between the porous nose and the body of the stopper rod.

The invention will now be described in greater detail with reference to the attached drawings, which present only one mode of execution, given for the sake of illustration.

BRIEF DESCRIPTION OF THE DRAWINGS

FIG. 2 is a cross-sectional side view of a stopper rod according to the invention, having a free space provided in the porous nose;

FIG. 5 is a side view of a molding form that facilitates development of a free space; and FIG. 6 is a plan view of the molding form of FIG. 5.

DETAILED DESCRIPTION OF THE INVENTION

Figure 1:
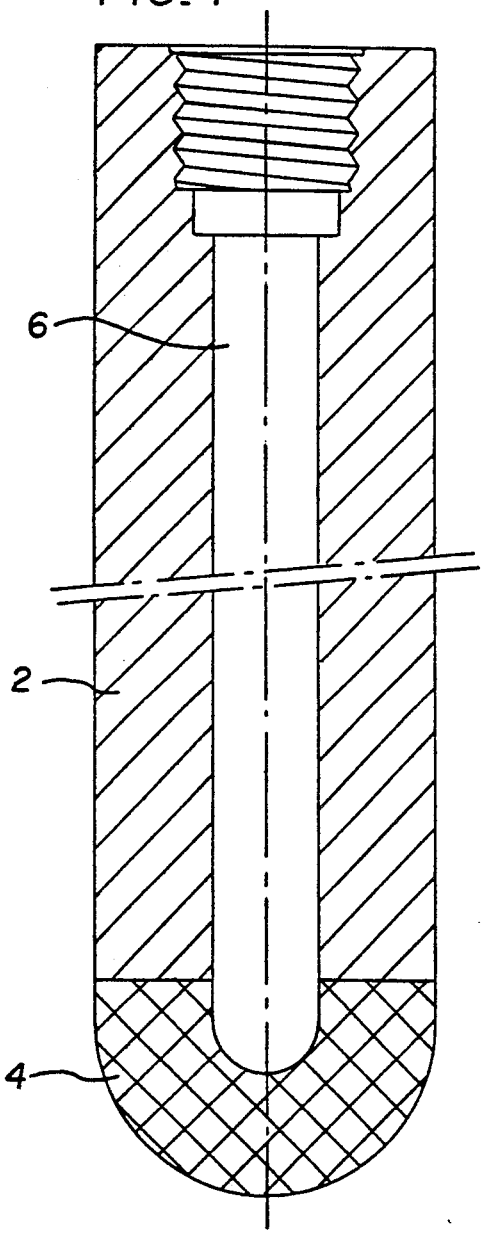
FIG. 1 is a cross-sectional side view of a stopper rod having a porous nose according to the prior art.

FIG. 1 shows a cross sectional view of a stopper rod designed to regulate the casting of a liquid, for example, molten steel according to known prior art. The prior art stopper rod is comprised of a non-porous refractory body 2 of general cylindrical form and a porous refractory nose 4 located at a lower end of the body 2. The body is traversed by a longitudinally extending axial channel 6. The entrance end of the axial channel 6 is threaded to fit a connection for feeding the stopper rod with an inert gas, for example, argon. The bottom end of channel 6 extends into the porous nose 4, to facilitate the introduction of inert gas thereto. The nose 4, for example, has a hemispherical or ogival form. It is found that in this embodiment the gas exchange surface area at the end of the axial channel 6 and the porous nose is reduced relative to the surface area on the exterior surface of the porous nose. Furthermore, the thickness of the porous nose 4 that is to be traversed by the inert gas is relatively substantial, of the order of 40 mm in a current commercial embodiment. Consequently, for a stopper rod of this type, the argon flow rate obtained at a temperature of 1500° C. does not exceed 8 Nl/min for a counterpressure created by the molten steel of 2.8 bar. Although such a gas flow rate is adequate in some cases, it is dangerous to work with such a high counterpressure in the stopper rod and in the gas feed system, as explained previously. In effect, there are risks of leakage in the area of the connection between the stopper rod and the gas pipes, as well as the risk of bursting of the refractory stopper rod.

FIG. 2 shows a cross-sectional view of a stopper rod according to the invention, having a gas distribution opening or free space formed in the porous refractory material of the nose 4. The embodiment of FIG. 2 is distinguished from the stopper rod of the prior art, shown in FIG. 1, by the fact that it has the gas distribution manifold defined by free space 8, formed in the porous material comprising the nose 4. In the example shown, the free space 8 is comprised of a substantially continuous open slot of essentially hemispherical or ogival shape and which is essentially concentric with to the outer surface 9 of the porous nose 4. It is noted that a plurality of spaced apart bridges 10 of refractory material connect the two edges of the slot. These bridges 10 strengthen the structure and prevent the loss of the outer part of the porous nose 4 when erosion due to the steel reaches the slot of free space 8.

It should be noted that the junction of interface 11 between the porous refractory material of the nose 4 and the non-porous refractory material of the stopper rod body 2 is, preferably, not traversed by the slot of free space 8 in order to avoid weakening this critical interface zone in which stresses are present by reason of the slightly different nature of the materials in contact.

In the exemplary embodiment shown in FIG. 2, the apex of the slot of free space 8 is tangent to the lower part of the axial channel 6 so as to communicate therewith in the area of the apex. Thus, the free space 8 is fed with inert gas directly through the end of channel 6, as well as through a number of radial passages 12 communicating with the axial channel 6 and the slot of the free space 8 that permit feeding of inert gas to the upper end of the slot of the free space. It is not necessary, however, that the slot be tangential to the end of the axial channel 6. In one modified embodiment, this slot could be included entirely in the material constituting the porous nose and, thus, spaced from the end of the axial channel 6.

The above-described free space 8 provides several advantages. The free space 8 makes it possible to reduce the thickness of the porous material to be traversed by the gas. In addition, due to the fact that the surface area of the free space slot is greater than the surface of the interface between the axial channel 6 and the lower part of the porous nose 4, the area of the exchange surface is increased. These two factors contribute to increasing the flow rate of inert gas for the same counterpressure value.

Figure 3:
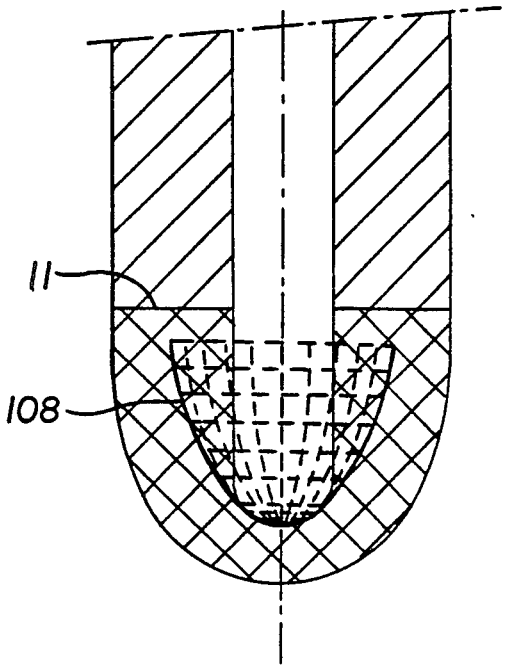
PRIOR ART FIG. 3
FIG. 3 is a partial, cross-sectional side view of a stopper rod depicting a further embodiment of a free space.

FIG. 3 shows a further presently preferred embodiment of the invention in which the gas distribution free space, instead of being comprised of an essentially continuous slot, is in the form of cup-shaped lattice network designated 108. The free space of network 108 is obtained by means of a net-like array of wax wire, which is eliminated by melting and vaporization during firing. In the embodiment of FIG. 3, the surface area of the free space of network 108 is smaller than in the preceding example of FIG. 2. Consequently, the exchange surface with the central passage 6 is also smaller than in the previous example. The advantage, however, that resides in introducing the inert gas close to the outer surface of the porous nose is preserved so that the flow rate of the gas is increased relative to the prior art stopper rod for an identical value of the counterpressure of the molten metal.

Figure 4:
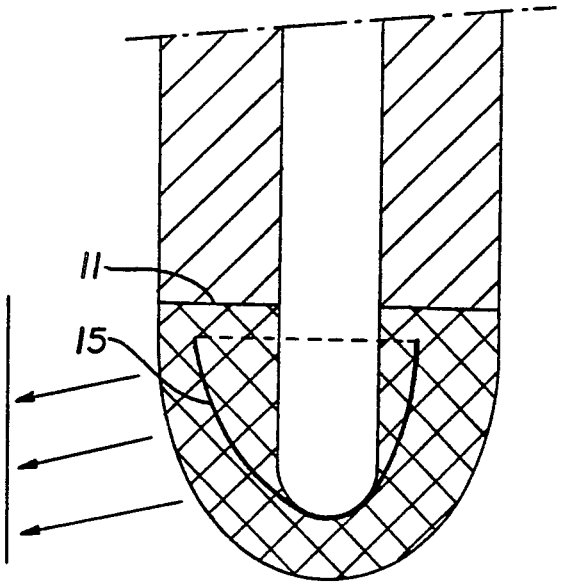
FIG. 4 is similar to FIG. 3 and shows a specially shaped slot to provide a zone of preferential inert gas blowing.

FIG. 4 shows another modified form of the present invention, in which the gas distribution free space is formed in an outwardly skewed manner to define a preferential blowing zone 15. The thickness of the porous material to be traversed by the gas in this embodiment is not constant, but, rather, is sharply diminished in the zone 15 where one wishes to obtain a preferential blowing. In this manner, the inert gas within the free space will more readily traverse the diminished thickness or porous material in zone 15 to provide a greater volume of gas flow in that zone.

It is thus apparent that the shape of the gas distribution free space is not limited to the several examples described herein, but the skilled artisan can adapt the shape of the free space as a function of his particular needs.

The manufacture of the stopper rod shown in FIGS. 2–4 will now be explained. A molding form 16 is placed on a mandrel (see FIG. 5); its shape corresponds to the shape of the gas distribution free space 8 that one wishes to obtain, for example, a continuous slot (FIG. 2) or a mesh network (FIG. 3) or any other form desired. This molding form is made of expendable material, of a known type, such as wax, that will be eliminated by melting and vaporization in a subsequent high temperature firing stage of the process. The molding form 16 also has a plurality of holes 20 formed therein which make possible the formation of the solid bridge areas 10, referred to above. In addition, centering rods 14 also of an expendable material, such as wax, assure the positioning of the molding form 16 on the pressing mandrel. Then, in a classic known manner, the pressing mandrel with the molding form 16 positioned thereon is placed in a pressing envelope that is filled first with non-porous refractory materials of the stopper rod body and then porous refractory materials of the nose 4. After isostatic pressing, the stopper rod is heated moderately, or dried, and then fired in a furnace. During the heating and/or firing operation, the molding form of wax is eliminated, leaving vacant the empty space defining the free space 8 or the network 108 desired as well as the radial channels 12 for the passage of the gas.

EXAMPLE

A stopper rod according to the invention, having a slot forming a gas distribution free space 8 of the type shown in FIG. 2, was produced. With this stopper rod, an increase in the argon flow rate up to 20 Nl/min. was measured at a steel temperature of 1500° C. and a counterpressure less than 2 bar. For comparison purposes, a stopper rod of the prior art of identical dimensions, at a temperature of 1500° C., was not capable of reaching an argon flow rate more than 8 Nl/min., a molten metal counterpressure of 2.8 bar. This comparison consequently shows that the invention makes it possible to increase the argon flow rate by a factor of 2 or more.

Although the invention was described principally with reference to a stopper rod, it is equally applicable to any casting of a fluid, comprised of a porous part and a nonporous part. It can also be advantageously applied to a pouring nozzle having a porous sleeve on the inside bore for the injection of a gas.

What is claimed is:

1. A stopper rod for regulating the flow of liquid in a metallurgical vessel comprising:

a body having a channel formed therein adapted to receive a pressurized gas; and a porous nose formed of a gas permeable refractory substantially throughout its interior joined with said body and having an open free space formed therein in a spaced relationship from an outer surface of said porous nose, said nose including means communicating with said channel and with said free space adapted to permit the passage of pressurized gas to said free space whereby the pressurized gas traverses the porous nose and exits therefrom into said liquid.

2. The stopper rod of claim 1 wherein the free space is defined by a hemisphere-like shaped slot.

3. The stopper rod of claim 2 wherein said hemisphere-like shaped slot of the free space has an apex area at a lowermost portion and wherein said apex area communicates with a lowermost end of said channel adapted to permit the passage of pressurized gas to said free space.

4. The stopper rod of claim 2 wherein the gas passage means includes a plurality of radial passages extending outwardly from said channel to the free space.

5. The stopper rod of claim 2 wherein the hemisphere-like shaped slot includes a plurality of spaced-apart bridges of porous nose material to strengthen said nose.

6. The stopper rod of claim 1 wherein the nose has an inner surface defined by a lower channel portion wherein the free space is in direct communication with said lower channel portion and wherein the free space has a surface area greater than a surface area of the inner surface of said nose.

7. The stopper rod of claim 6 wherein the free space is defined by a hemisphere-like shaped slot which is positioned in a spaced relation between said inner and outer surfaces of the nose.

8. The stopper rod of claim 6 wherein the free space is generally concentric with an outer surface of said nose.

9. The stopper rod of claim 1 wherein the free space is formed within said porous nose in a spaced relationship from an interface joining said nose and body.

10. The stopper rod of claim 1 wherein the free space is formed by a plurality of open channels defining a cup-shaped lattice network.

11. The stopper rod of claim 1 wherein the free space is formed in an outwardly skewed manner to provide an area of porous material of diminished thickness to define at least one preferential blowing zone.

12. A refractory stopper rod for regulating the flow of molten metal in a metallurgical vessel comprising:

a body having a channel formed therein adapted to receive a pressurized gas;

a porous nose formed of a gas permeable refractory substantially throughout its interior co-pressed and fired with said body and having an inner surface coextensive with the channel of said body, and having an outer surface adapted to contact the molten metal and to emit bubbles of said gas therein, said porous nose having an open free space formed therein and positioned in a spaced relationship between the inner and outer surfaces of the porous nose and having means communicating with said channel and said free space, adapted to permit the passage of pressurized gas to said free space for permeation therefrom to the outer surface.

* * * * *